US005086987A

United States Patent [19]

Shieh

[11] Patent Number: 5,086,987

[45] Date of Patent: Feb. 11, 1992

[54] METHOD OF MAKING ROLLS OF RECORD MEMBERS

[75] Inventor: Roung-Min Shieh, Miamisburg, Ohio

[73] Assignee: Monarch Marking Systems, Inc., Dayton, Ohio

[21] Appl. No.: 342,279

[22] Filed: Apr. 24, 1989

[51] Int. Cl.[5] ..... B32B 3/16; B65H 75; B65H 19/00

[52] U.S. Cl. ..... 242/56 R; 156/184; 156/277; 83/371; 400/248; 242/74; 242/68.5; 242/DIG. 2

[58] Field of Search ..... 242/56 A, 56 R, 74, 242/68.5, DIG. 2; 101/226, 26, 44, 181; 400/268, 248; 156/64, 187, 277, 361, 184, 64, 353; 83/370, 371, 649

[56] References Cited

U.S. PATENT DOCUMENTS

| | | | |
|---|---|---|---|
| 3,470,052 | 9/1969 | Herman | 156/184 |
| 3,783,783 | 1/1974 | Hamisch, Sr. | 101/226 |
| 3,827,355 | 8/1974 | Hamisch, Sr. | 101/226 X |
| 4,081,309 | 3/1978 | Jenkins | 156/184 X |
| 4,221,144 | 9/1980 | Diesch et al. | 83/371 X |
| 4,227,983 | 10/1980 | Gursky et al. | 156/184 X |
| 4,297,403 | 10/1981 | Smith | 156/184 X |
| 4,776,714 | 10/1988 | Sugiura et al. | 400/248 |

*Primary Examiner*—Daniel P. Stodola
*Assistant Examiner*—Paul T. Bowen
*Attorney, Agent, or Firm*—Joseph J. Grass

[57] ABSTRACT

There is disclosed a roll of a web of record members, wherein the web has outer and inner end portions free of machine-readable marks and wherein the outer end portion is free of other preprinted information. Also disclosed is method of making such rolls.

35 Claims, 7 Drawing Sheets

METHOD OF MAKING ROLLS OF RECORD MEMBERS

BACKGROUND OF THE INVENTION

1. Field of the Invention

This invention relates to the art of record member rolls and of making same.

2. Brief Description of the Prior Art

It is known in the art to make rolls of webs of record members, for example, rolls of tags and labels, with machine-readable marks on one side of the web and optionally with no preprinted information, or with preprinted information on one or both sides of the web. Typically, the marks are used to register the tag or label with the printer which prints price and possibly other data and/or with a cut-off knife which severs the tags from the remainder of the web. Machine-readable marks are provided on the tag or label webs at regularly spaced apart intervals. The marks extended continuously throughout the length of the web section on the roll. In the event the web section has transverse cuts or perforations to define individual labels or to define tags or parts of tags, the machine-readable marks are registered with such cuts or perforations.

It is common practice to wind the web into a core. The inner marginal end is generally adhesively secured to the core to provide a secured inner wrap or inner loop and the remainder of the web is wound about the core and the inner loop. The outer wrap or outer loop is normally held in place by an adhesive or by a piece of pressure sensitive tape. Although not as common, it is well known to make coreless rolls by wrapping the inner marginal end about itself to provide an inner loop and adhesively securing the inner loop in loop form.

Although tag and label webs as described above have been found acceptable for use in certain mechanical printers, problems have arisen when used in connection with thermal printers. One of the problems is that the adhesive or adhesive tape used either to adhere the inner wrap or inner loop to the core or to itself in the case of a coreless supply would come into contact with the thermal print head. When the web section is near its end, it has happened that the inner loop broke loose at the adhesive bond and as the web advances toward the print head the adhesive eventually comes into contact with the print head. Adhesive build-up on the thermal print head is undesirable because it results in degradation of the print quality and increases the frequency at which the print head must be cleaned or replaced. Another problem is that the adhesive applied to the outer loop or outer wrap to hold the outer loop in place can also come into contact with the thermal print head if the outer loop is not torn off and discarded. Even if pressure sensitive tape is used to hold the outer loop in place and even if this tape is removed, a small amount of the adhesive remains on the outer marginal end portion and can come into contact with the thermal print head during use. Still another problem is that the outer loop sometimes becomes dirty or collects dirt which can damage the thermal print head, cause degradation of print quality, and require more frequent cleaning or replacement of the print head.

The following United States patents are made of record: Paul H. Hamisch, Sr., U.S. Pat. No. 3,783,783 granted June 4, 1970; Paul H. Hamisch, Sr. U.S. Pat. No. 3,827,355 granted Aug. 6, 1974; and Ikuzo Sugiura et al U.S. Pat. No. 4,776,714 granted Oct. 11, 1988.

SUMMARY OF THE INVENTION

The above-mentioned problems can be avoided with the present invention. A thermal printer of the type with which the record member web of the invention is used has the feature that the printer is disabled when a machine-readable mark is not sensed within a predetermined time interval. Accordingly, machine-readable marks are deleted from the marginal end portions of the web in order to prevent adhesive on these marginal end portions from being advanced into contact with a thermal print head.

The invention pertains to improved method of making rolls of webs of record members, and to such rolls which avoid the above-mentioned problems.

It is an object of the invention to provide an improved method of making rolls of webs of record members, e.g. tags or labels, on a production basis, wherein problems resulting from adhesive and/or dirt carried by the web contacting a thermal print head during use in a thermal printer will be substantially minimized or eliminated.

It is a further object of the invention to provide an improved method of making a roll of a web of record members, wherein the method comprises providing a longitudinally extending web of printable record material, printing machine-readable marks on the web with the marks being arranged in longitudinally spaced groups with intervening gap portions between the groups and with the marks within each group occurring at equally spaced apart intervals, advancing the web in a leading direction, completely severing the web transversely at selected longitudinal positions within each gap portion to provide web sections with leading gap portions, winding each leading gap portion to provide an inner loop, securing the inner loop in loop form, and winding the remainder of each web section about its inner loop.

It is a further object of the invention to provide an improved method which comprises providing a longitudinally extending web of printable record material, printing information on the web in accordance with a series of record members lengthwise of the web with preprinted information resulting from the web being arranged in longitudinally spaced groups with intervening gap portions between the groups and with the preprinted information within each group occurring at equally spaced apart intervals, advancing the web in a leading direction, completely severing the web transversely at a selected longitudinal position within each gap portion to provide web sections with trailing gap portions, winding each web section to form a wound roll, each trailing gap portion forming an outer loop of the respective wound roll, and adhesively securing each trailing gap portion in loop form about the remainder of the respective web section.

It is a still further object of the invention to provide an improved roll of a web of record members such as tags or labels in which adhesive used to hold the inner loop of the roll in tact or adhesive used to hold the outer loop in tact, or both, is prevented from having an adverse affect on a thermal printing head and/or on print quality.

It is still a further object of the invention to provide a roll of a continuous record members with an outer wrap which is free of machine-readable marks, or preprinted information, and preferably is free of both machine readable marks and preprinted information. The outer wrap thus serves as a protective covering to protect the record members from dirt and damage and discourages use of the outer wrap in the printer. It is preferred that the user tear off and discard the outer wrap and the lack of printing thereon encourages this.

In accordance with one specific embodiment of the method of the invention there is provided a method of making wound rolls of record members for use in a printer which includes providing a longitudinally extending web of record material having opposite printable sides, preprinting information on one side of the web in accordance with a series of record members extending lengthwise of the web, with repetitively occurring preprinted information resulting from the preprinting being arranged in longitudinally spaced preprint groups with intervening preprint gap portions between the preprint groups and with the preprinted information within each preprint group occurring at equally spaced apart intervals, printing machine-readable marks on the other side of the web with the marks being arranged in longitudinally spaced mark groups with intervening mark gap portions between the mark groups and with the marks within each mark group occurring at equally spaced apart intervals, wherein each mark is aligned and registered with said preprinted information, advancing the web in a leading direction, completely severing the web transversely at a selected longitudinal position within each mark gap portion to provide web sections each having a leading mark gap portion and a trailing mark gap portion, providing a core for each web section, wherein the transverse severing makes all the leading preprint and mark gap portions of substantially equal length with each leading preprint and mark gap portion being at least slightly longer than the circumference of the respective core and makes the trailing preprint and mark gap portions of substantially equal length, with each trailing preprint and mark gap portion being at least slightly longer than the circumference of the wound roll, adhesively securing only the leading preprint and mark gap portion of each web section to its respective core, winding the remainder of each web section onto the respective core, each trailing preprint and mark gap portion forming an outer loop of the respective wound roll, and adhesively securing each trailing preprint and mark gap portion in loop form about the remainder of the respective web section.

In accordance with one specific embodiment of the wound roll of the invention there is provided a longitudinally extending web of printable record material wound into a roll, regularly spaced machine-readable marks on a substantial portion of the length of the web, the web having a marginal end portion free of said marks, the marginal end portion being wound to provide an inner loop, means for adhesively securing the inner loop in loop form, wherein the marginal end portion is longer than the extent of the inner loop, the web having another marginal end portion free of preprinted information and/or said marks, wherein the other marginal end portion provides an outer loop of the roll, and wherein said other marginal end portion is longer than the circumference of the wound roll.

BRIEF DESCRIPTION OF THE DIAGRAMMATIC DRAWINGS

Figure 16:
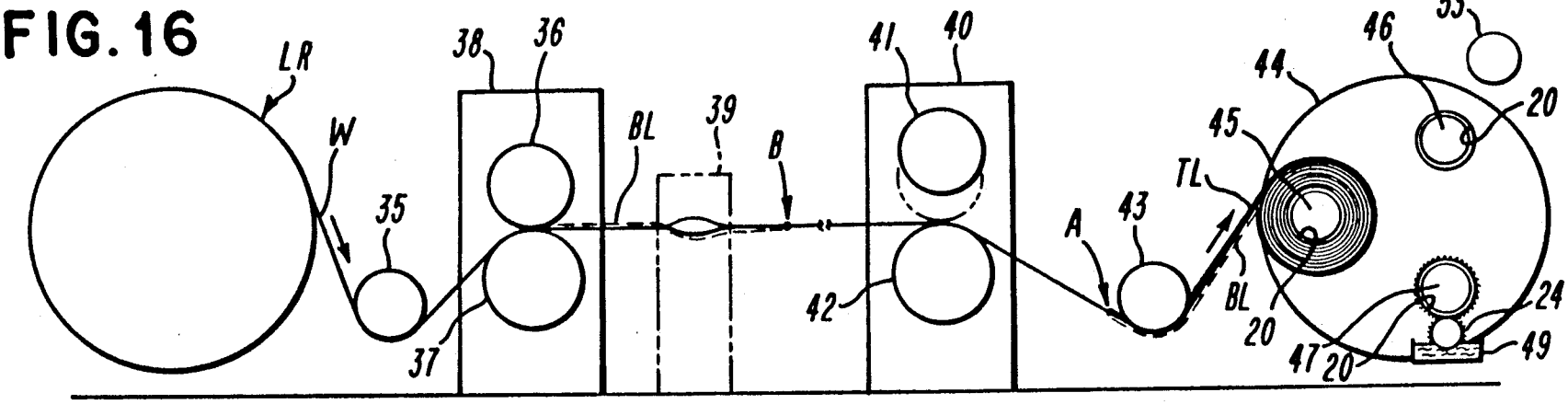
FIG. 16 is a view similar to FIG. 15, but showing the rolls for printing the preprinted information as having been separated to interrupt the printing of preprinted information at point A.
Figure 17:
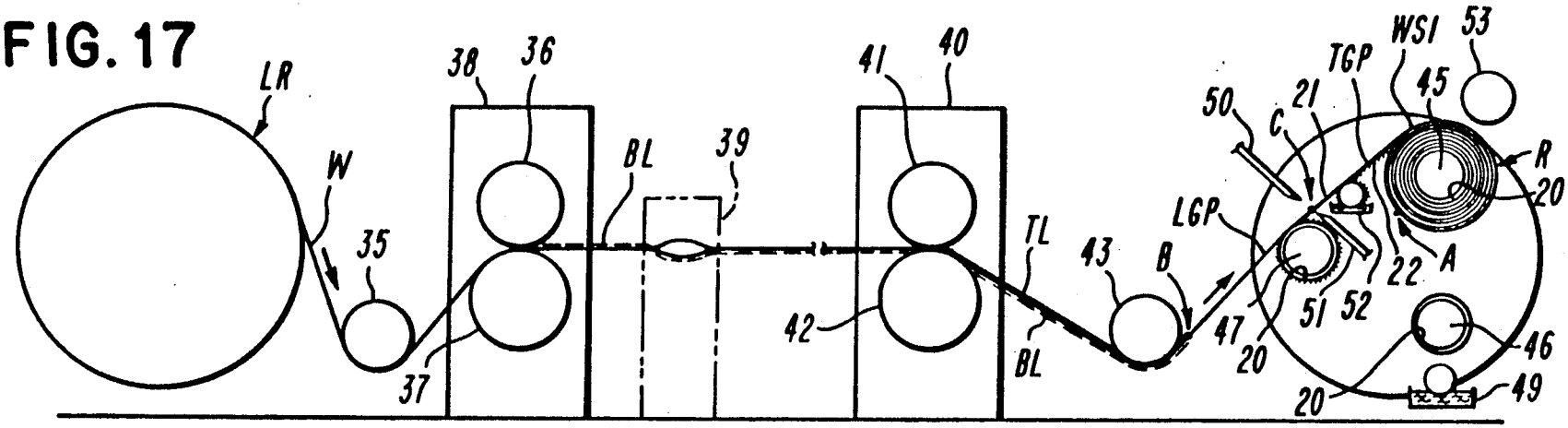
Figure 18:
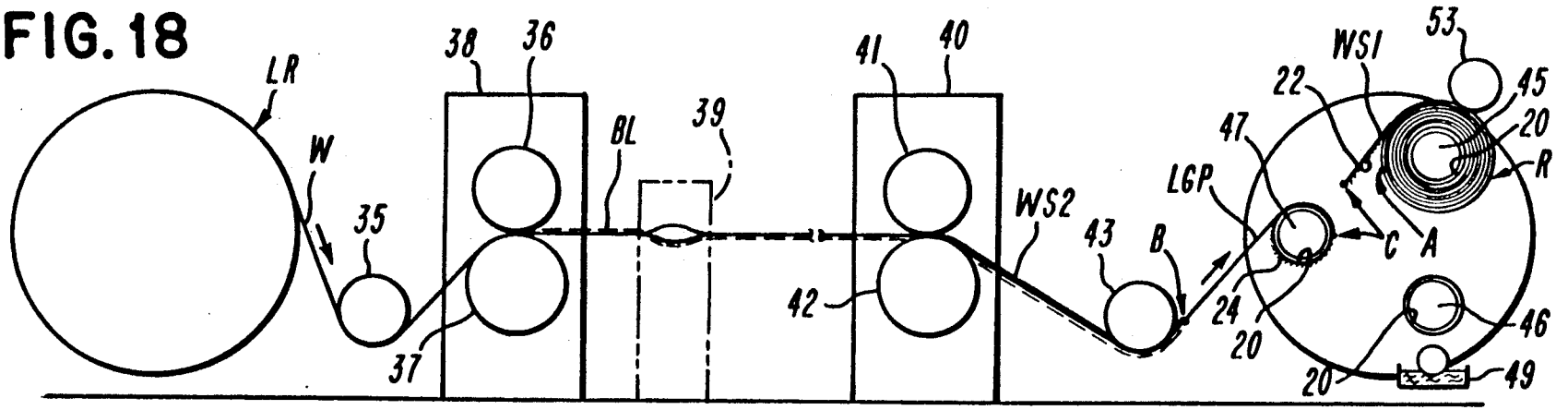

FIG. 17 is a view similar to FIG. 16, but showing the rolls for printing the preprinted information as having been moved into printing cooperation so that preprinted information is again printed starting at point B, and showing the knife ready to cut the web at point C; and FIG. 18 is a view similar to FIG. 17, but showing the knives as having completely severed the web transversely, with the winding of the one roll being substantially completed and with the winding of the next roll having commenced.

DETAILED DESCRIPTION OF THE PREFERRED EMBODIMENTS

Figure 1:
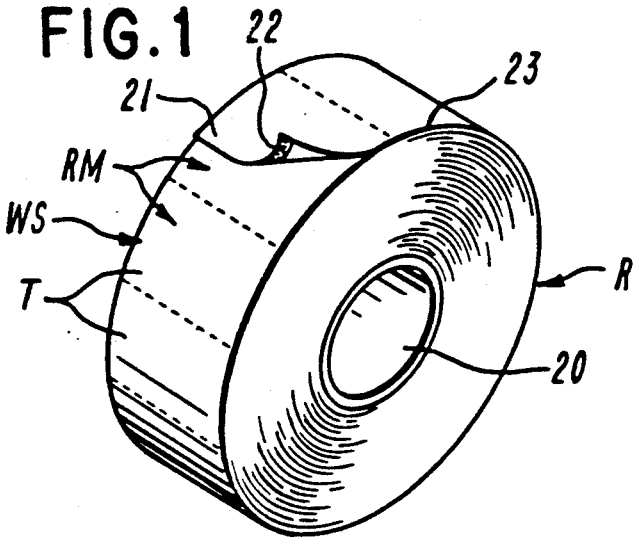
FIG. 1 is a perspective view of a wound roll of a web of record members in accordance with the invention.

Referred to FIG. 1, there is shown a roll R of a web section WS of record members RM. The roll R is shown to have been wound onto a core 20. The record members RM are specifically shown to be tags T although they could as well be pressure sensitive labels releasably adhered to a carrier web section. The outer end margin 21 of the web section WS has adhesive 22 on its underside and holds the outer wrap or outer loop 23 in loop form.

Figure 2:
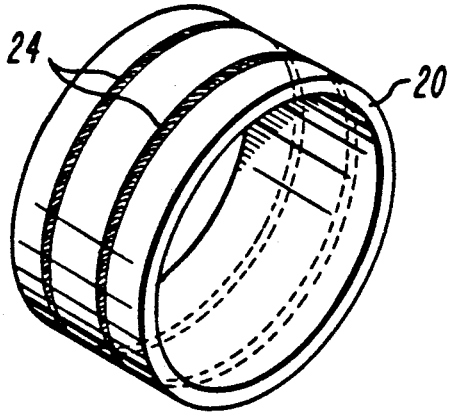
FIG. 2 is an enlarged perspective view of a core for the roll shown in FIG. 1.

FIG. 2 shows the core 20 as preferably having a pair of axially spaced, continuous, circumferentially extending stripes or zones of hot-melt adhesive 24 applied to its outer periphery. Other patterns of adhesive can be used if desired. The core 20 is typically comprised of cardboard, although various natural or synthetic materials can be used.

Figure 3:
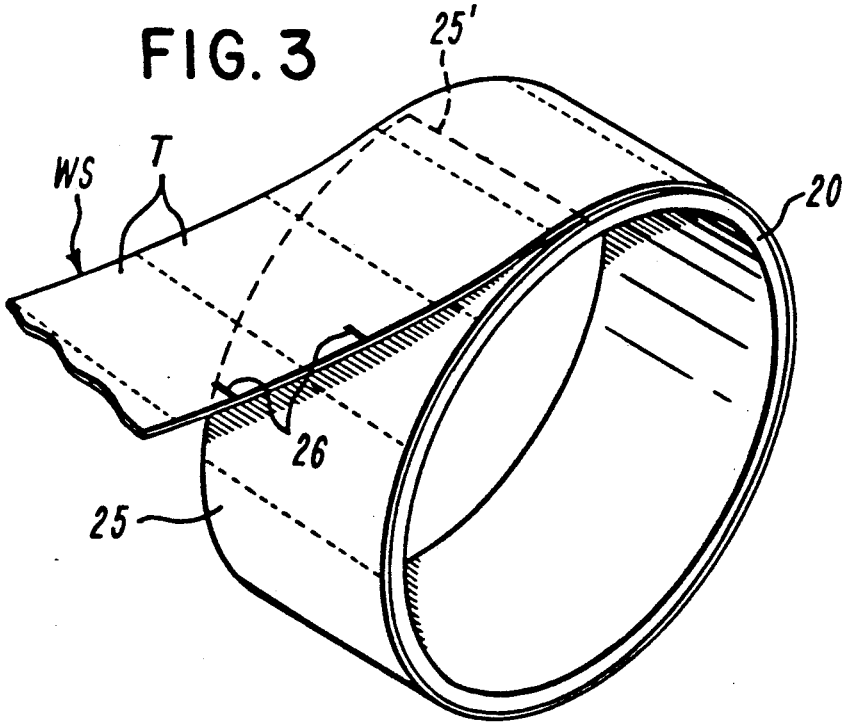
FIG. 3 is an enlarged perspective view of the core shown in FIG. 2, with a marginal end portion of the web shown wound onto the core.
Figure 4:
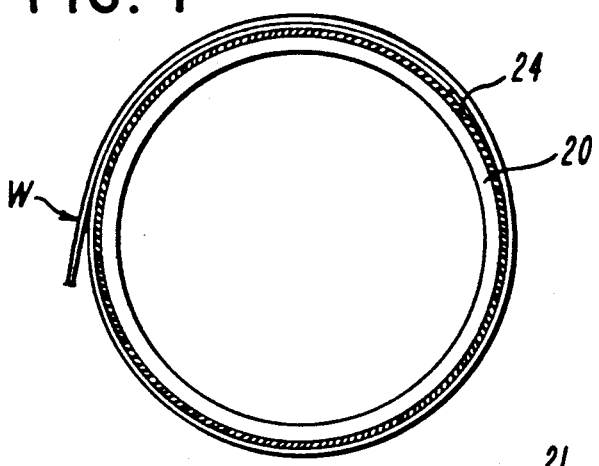
FIG. 4 is an end elevational view of the core and marginal end portion shown in FIG. 3.

FIG. 3 shows the inner wrap or inner loop 25 of the web section WS as having been wound onto and consequently adhesively adhered to the core 20. As is apparent, the adhesive 24 only contacts the inner loop 25 and the remainder of the web section WS is masked from the adhesive 24 by the inner loop 25 itself. As shown, machine-readable marks 26 have been printed on the web section WS. The marks 26 are preferably equally spaced and terminate short of the inner loop 25. Assume that a thermal printer has been printing data on the tags T and that the web section WS has been advanced to the extent that the inner loop 25 is separated from the core 20. This separation can occur by tearing or by delamination. As the web section WS and its delaminated inner loop 25 advance through the printer, the printer senses the last mark 26 on the web section WS and becomes disabled when it fails to sense another mark 26 within a period of time slightly in excess of the time it would take for another mark to be advanced to the sensor. The printer assumes there is a jam or out-of-stock condition and is disabled. The adhesive 24 on the inner loop 25 cannot contact the thermal print head because the advance of the web section WS is interrupted before the delaminated adhesive-bearing inner loop 25 reaches the thermal print head.

Figure 6:
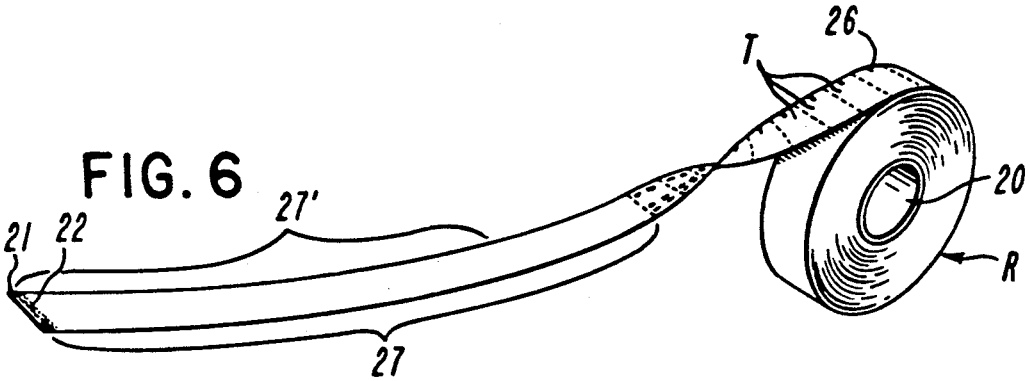
FIG. 6 is a perspective view of the wound roll in accordance with the invention with a portion of the roll unwrapped and twisted to show that there is no printing on one side of an end portion of the web.

As shown in FIG. 6, outer marginal end portion 27 is preferably free of any printing. The length of the marginal end portion 27 is at least slightly longer than the circumference of the roll R, as measured before the marginal end portion 27 is wound onto the underlying wraps.

Figure 7:
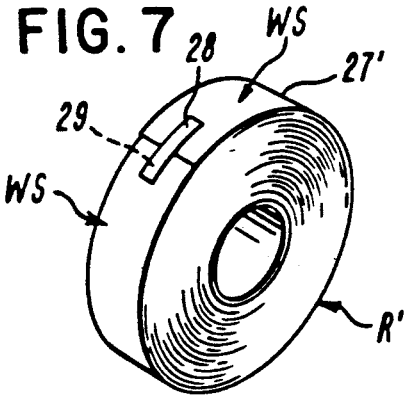
FIG. 7 is a perspective view of a wound roll in accordance with the invention, but showing pressure sensitive tape, instead of an adhesive coating, holding the outer loop wrapped in loop form.

Roll R' shown in FIG. 7 is identical to the roll R except that instead of the adhesive 22, a strip of pressure sensitive tape 28 is applied to hold outer loop 23 in tact. It should be noted that even though the tape 28 is delaminated from the roll R' prior to use of the web W, small amounts of adhesive from the delaminated tape 28 cling to the outer loop 23 and on the immediately adjacent portion 29 of the web section WS.

Figure 8:
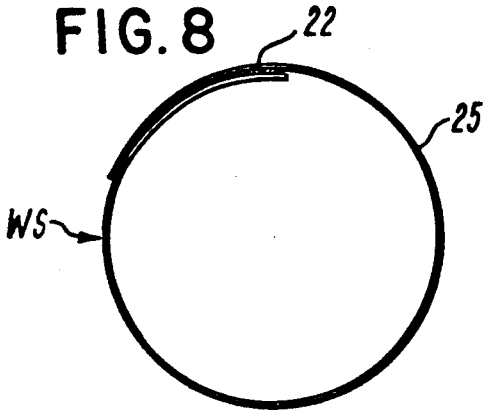
FIG. 8 is a side elevational view of an inner marginal end of a coreless roll, with the inner marginal end being held in loop form by a coating of adhesive.

With reference to FIG. 8 there is shown a portion of the web section WS for a coreless roll. Nevertheless, a coating of adhesive 22 holds inner loop 25 in loop form. It is apparent that the invention is applicable both to rolls with cores and to coreless rolls.

Figure 9:
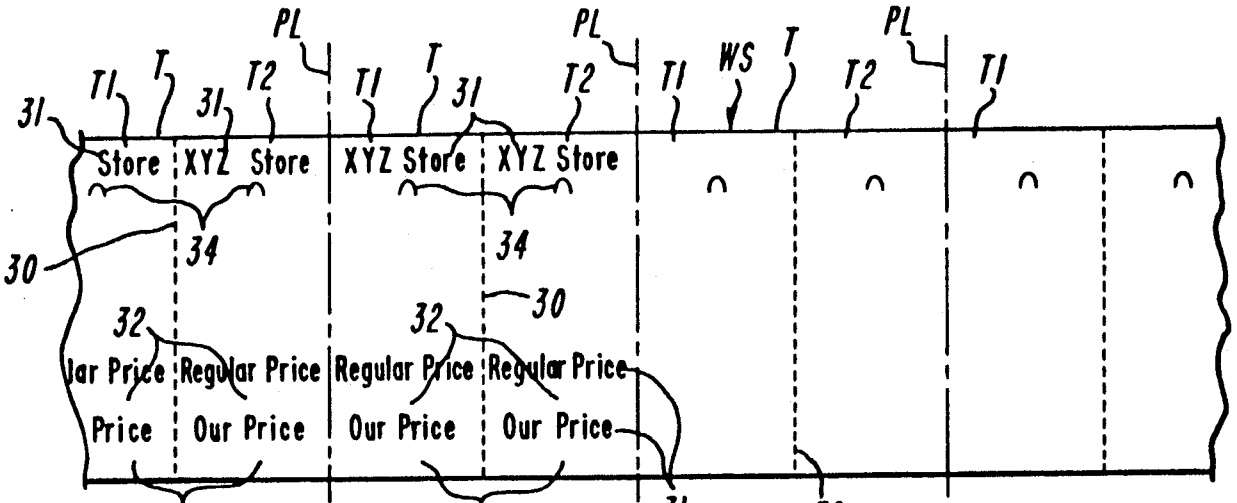
FIG. 9 is an enlarged top plan view of a fragment of a web of tags.
Figure 10:
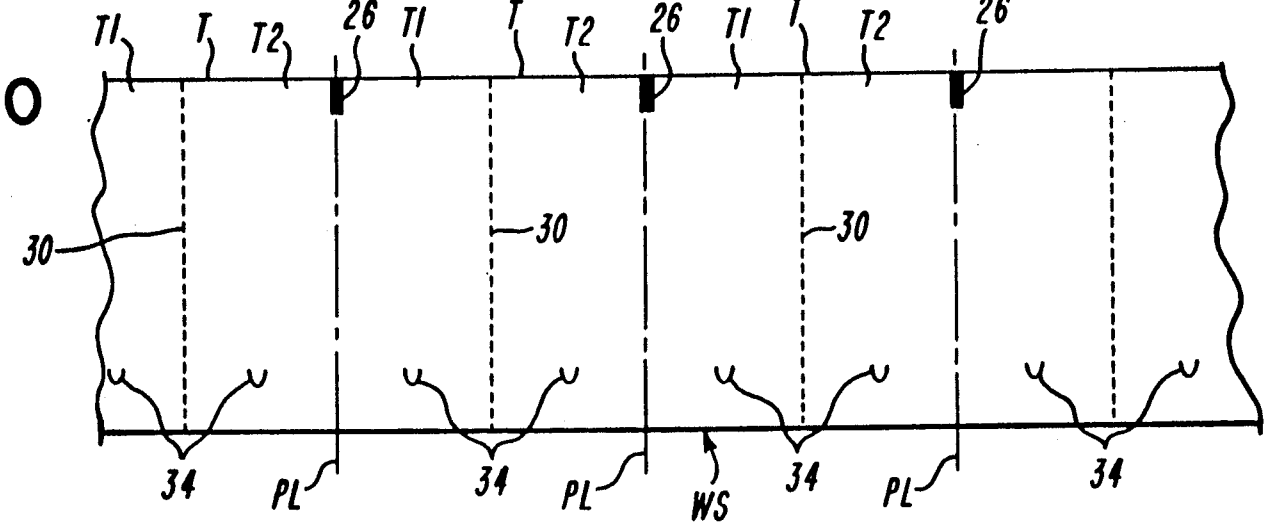
FIG. 10 is a bottom plan view of the web of tags shown in FIG. 9.

With reference to FIG. 9, there is shown a fragmentary portion of the web section WS. The illustrated web section WS is comprised of tags T of the two-part type, as are useful in retail stores. Each tag T has a central line of partial severing 30 which is shown to comprise a perforation cut. Each tag T is comprised of the portion of the web section WS between adjacent phantom lines PL. As shown each phantom line PL is midway between adjacent lines of partial severing 30. When the prices have been printed on the tags T in the thermal printer, the tags T are completely severed one-by-one from the remainder of the web section WS. Accordingly, each tag T is a two-part tag having tag parts T1 and T2. One side of the web section WS is provided with repetitively occurring, regularly spaced and preferably equally spaced preprinted information 31. When the web section WS is used in a thermal printer at a user's facility, the user causes the printer to print in areas 32 and 33. In the illustrated example, the user's printer would print both the regular and the sale price. The tag sections T1 and T2 are also shown to be provided with U-shaped cuts 34 which form chadless attacher holes for receiving plastic fasteners of the type sold by Monarch Marking Systems, Inc., Dayton, Ohio under its registered trademark "TAGGER TAIL".

Figure 11:
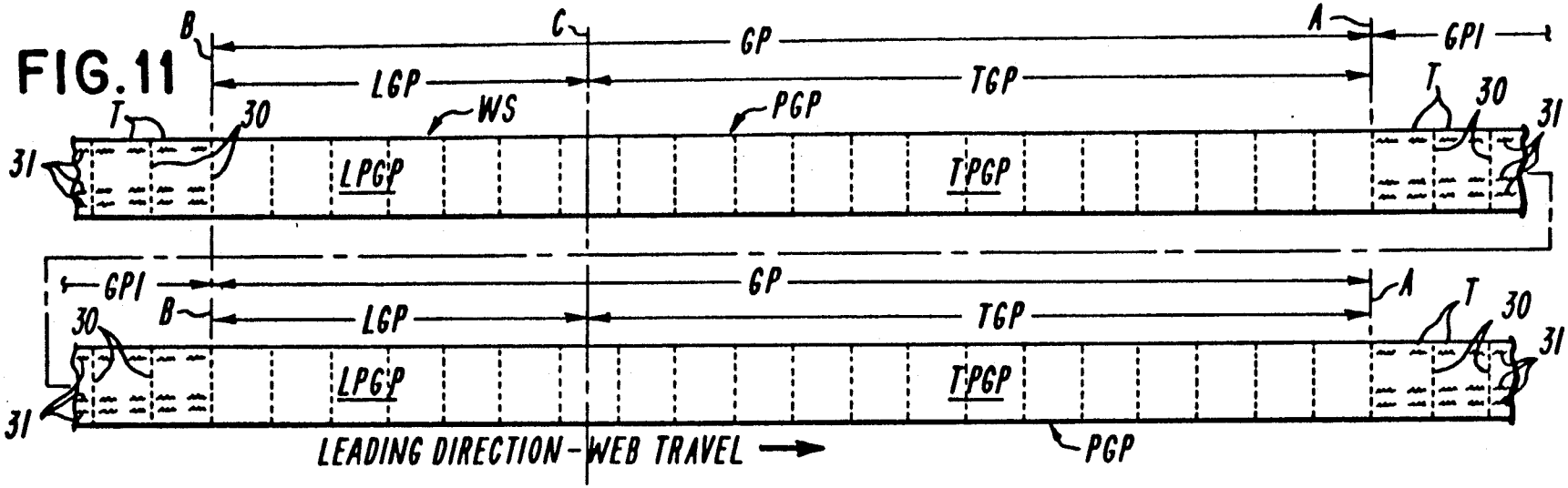
FIG. 11 is a fragmentary top plan view of a portion of a tag web showing preprinted tags separated by blank or gap portions.
Figure 12:
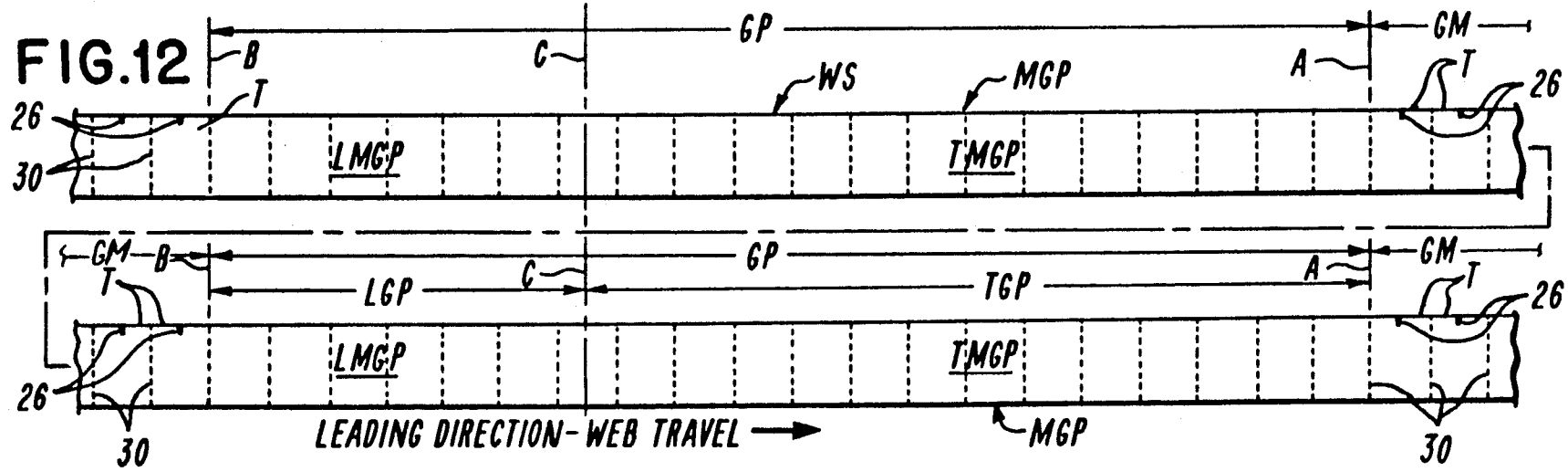
FIG. 12 is a fragmentary bottom plan view of a portion of a tag web shown in FIG. 11, showing the tags aligned with tags in FIG. 11.

FIGS. 11 and 12 show opposite sides of a fragmentary portion of the web section WS. The expression "web section" as used herein means the web material which is wound into a roll R or R'. In practicing the invention, a web W (FIGS. 13 through 18) wound into a large roll LR is printed with the preprinted information 31. In the web section WS illustrated in FIGS. 11 and 12, the preprinted information 31 would be registered with the lines of partial severing 30. The machine-readable marks 26 are likewise registered with the lines of partial severing 30 and with the preprinted information 31. In the illustrated web section WS, the marks 26 are along the lines PL at which the individual tags T will be severed by the thermal printer or by a separate cut-off mechanism. Each gap or space between the printing on the web W is referred to as a gap portion GP. Thus, a gap portion GP intervenes between a pair of adjacent groups of marks 26 and groups of preprinted information 31. The gap portion GP comprises a leading gap portion LGP and a trailing gap portion TGP. The gap portion GP on the side of the web section WS which contains the preprinted information is referred to herein as the preprint gap portion PGP, and the gap portion GP on the side of the web section WS which contains the marks 26 is referred to herein as the mark gap portion MGP. The trailing gap portion TGP on the preprint side is further referred to as the trailing preprint gap portion TPGP, and the trailing gap portion TGP on the mark side is further referred to as the trailing mark gap portion TMGP. Likewise the leading gap portion LGP on the preprint side is further referred to as the leading preprint gap portion LPGP, and the leading gap portion on the mark side is referred to as the leading mark gap portion LMGP. While it is preferred for cost reasons to leave the preprint gap portion PGP free of all printing, it could be printed with instructions or a trademark or other information if desired.

In the manufacture of tags T as illustrated, it is conventional to print warranty information and the like on the side of the web section WS opposite the side bearing the preprinted information 31. While the mark gap portions shown in FIG. 12 are free of any printing except for marks 26, the mark side of the web section WS can optionally be provided with such warranty information and the like, so long as it does not interfere with sensing of the marks 26. While it is evident that the preprinted information 31 appears on one side of the web section WS and the marks 26 appear on the opposite side of the web section WS, the preprinted information 31 and the marks 26 can be printed on the same side of the web if desired, so long as the thermal printer could read the marks 26.

Figure 13:
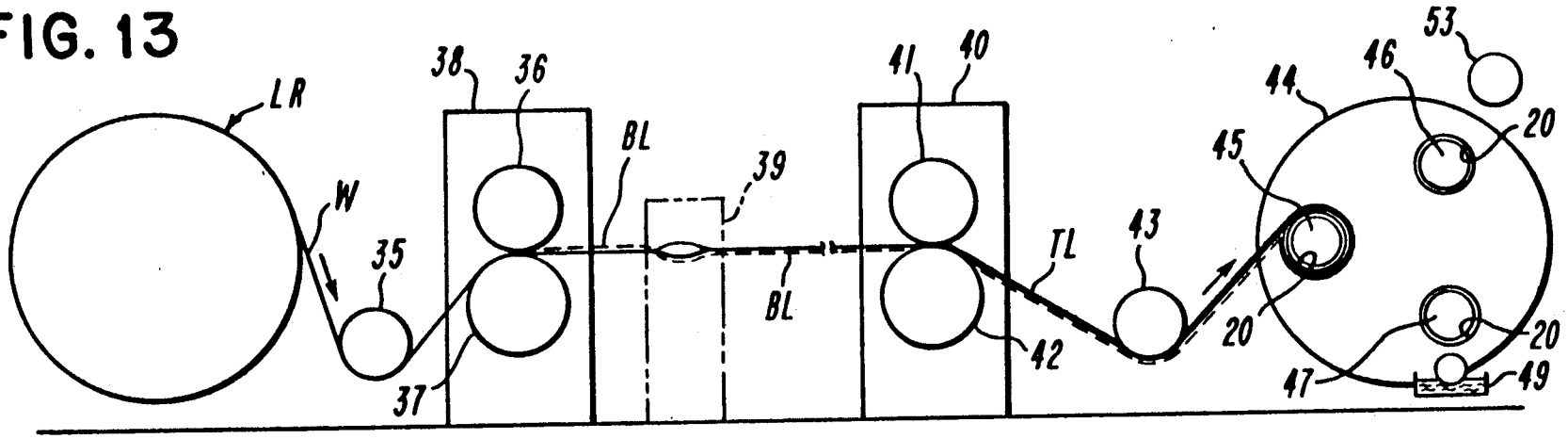
FIG. 13 is a diagrammatic elevational view showing the printing on the web of the machine-readable marks represented by a broken line and preprinted information represented by a solid line, with the web being wound into a core.

Referring now to FIGS. 13 through 18 and initially to FIG. 13, the longitudinally extending web W is being drawn from the large roll LR. The web W is typically wide enough for producing a number of tags across its width. A typical width for the web W is 6 inches (15.24 cm). The web W is shown to pass about a guide roll 35 and into printing cooperation with a printing roll 36 and a back-up roll 37 at a printing station 38. The printing roll 36 prints the machine readable marks 26 on the web as indicated by broken line BL. After the web W leaves the nip of rolls 36 and 37 it passes through a device 39 which inverts the moving web W, that is, the web W is turned 180°, so that the upper surface of the web W which contains the marks 26 is now the lower surface of the web W. The device 39 contains sets of turning bars, but the details of the device 39 form no part of the invention. The web W passes from the device 39 to another print station 40 having a printing roll 41 and a back-up roll 42. The printing roll 41 prints the preprinted information 31 on the web W. For clarity, the web W and the preprinted information together are represented by a thicker line TL than the line used for representing the web W alone. The web W is shown to pass from the nip of the rolls 41 and 42 about a guide roll 43 and is shown in the process of being wound onto the core 20. Not shown in FIGS. 13 through 18 is a slitter between the print station 40 and the turret rewinder 44 which slits the web W into a series of narrow webs according to the desired tag width. A turret rewinder 44 has a plurality of mandrels 45, 46 and 47. Accordingly, the mandrel 45 and the other mandrels 46 and 47 are each loaded with a series of separate cores corresponding to the width of the narrow tag webs.

Figure 14:
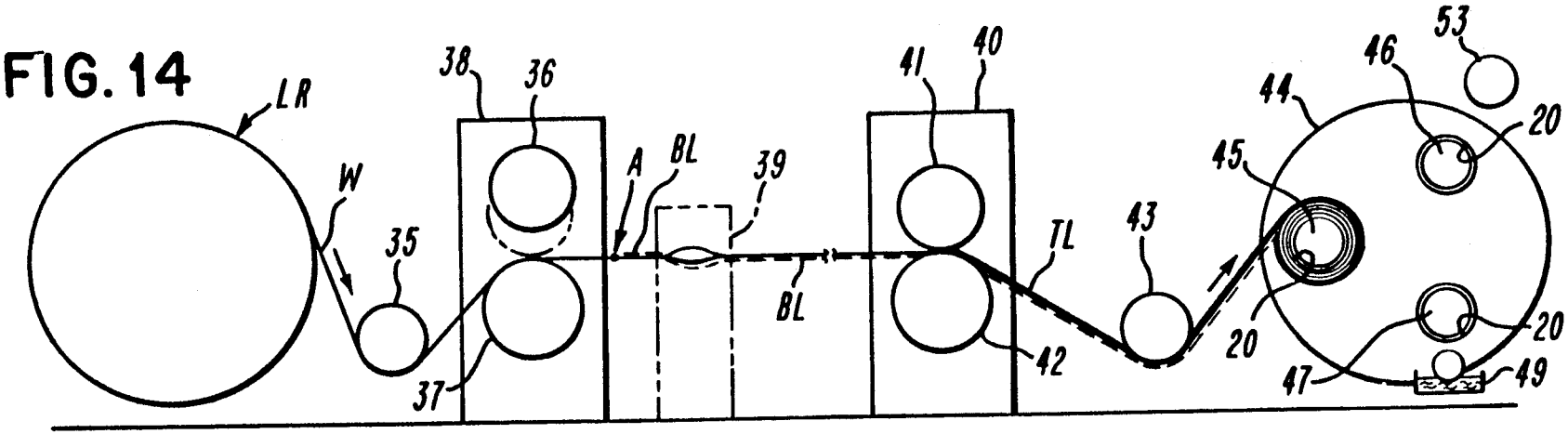
FIG. 14 is a view similar to FIG. 13, but showing the rolls for printing the machine-readable marks as having been separated to interrupt the printing of machine-readable marks at point A.

A substantial portion and preferably almost the entire web W is printed with the marks 26 and the preprinted information 31. The marks 26 and the preprinted information 31 are aligned. Each web section WS contains one mark group GM of marks 26 and one preprint group GPI of preprinted information 31. To provide the mark gap portion MGP and the preprint gap portion PGP, the printing rolls 36 and 41 are selectively moved out of printing cooperation with their respective back-up rolls 37 and 42. The mark gap portion MGP and the preprint gap portion PGP are aligned and registered. FIG. 14 shows the printing roll 36 as having been moved from its printing position indicated by a phantom line into a non-printing position indicated by a solid line. FIG. 16 shows the printing roll 41 as having been moved from its printing position indicated by a phantom line into a non-printing position indicated by a solid line.

With reference to FIG. 14, when the printing roll 36 moves out of printing cooperation with the back-up roll 37, printing of marks 26 is interrupted as shown by point A. Point A on the web W is shown in FIG. 14 as being to the right of the rolls 36 and 47 and the lack of printing to the left of point A is illustrated by absence of the broken line BL to the left of point A. With continued reference to FIG. 14, the web W passes through the device 39, through the print station 40 and the web W slit into narrow webs continues to be wound onto the cores 20 on the mandrel 45.

Figure 15:
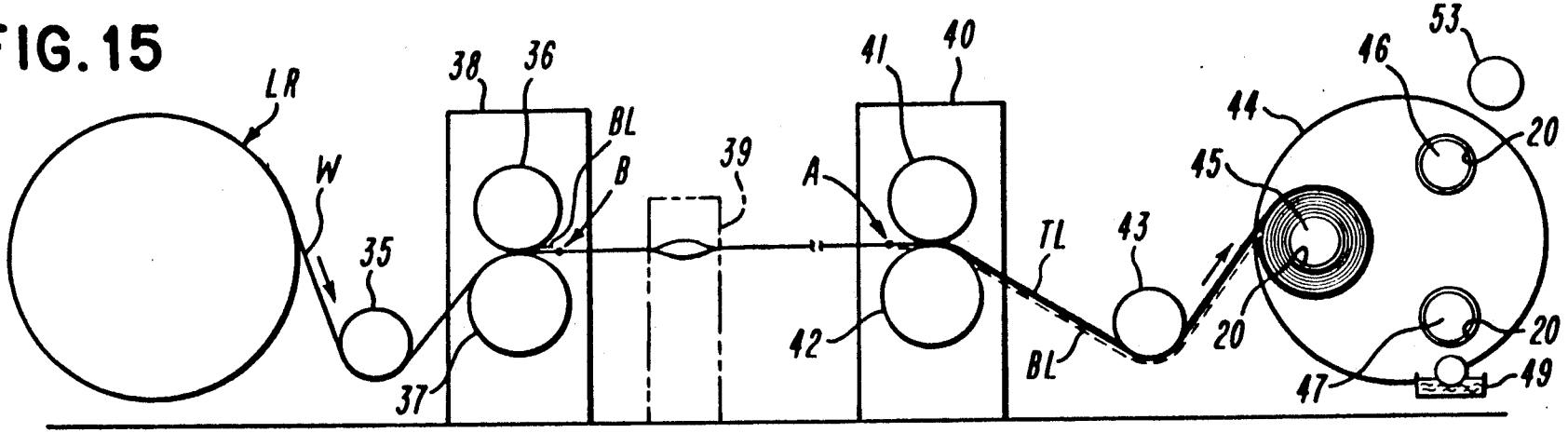
FIG. 15 is a view similar to FIG. 14, but showing the rolls for printing the machine-readable marks as having been moved into printing cooperation so that machine-readable marks are printed starting at point B.

With reference to FIG. 15, the printing roll 36 has been moved into printing cooperation with back-up roll 37 and printing recommenced at point B. It is apparent that the web W is devoid of marks 26 between points A and B. The web W continues to be printed, slit and rewound. FIG. 15 shows point A as being close to the nip of rolls 41 and 42. It should be noted that the print stations 38 and 40 are typically substantially further apart than the distance between points A and B shown in FIG. 15, for example. For example, point A shown in FIG. 15 can be several gap portions GP away from point B shown in FIG. 15. It is not critical as to how far apart the print stations 38 and 40 are. It only matters that the printing rolls 36 and 38 are moved into and out of printing cooperation with the web W at the proper times to provide the gap portions GP. It is preferred that the gap portions GP in the web are preferably of equal length.

With reference to FIG. 16, the roll 41 has moved from its phantom line position to its solid line non-printing position. Printing of the preprinted information 31 by the printing roll 41 on the web W ceased at point A.

An adhesive coating mechanism 49 illustrated in FIGS. 13, 14 and 15 as being in an ineffective or non-coating position is shown in FIG. 16 as having been moved to a coating position to coat stripes of adhesive 24 on the cores 20 on the mandrel 47.

When the web W has advanced to a position where point B is between the rolls 41 and 42, the printing roll 41 is moved into printing cooperation with the back-up roll 42 and printing recommences as shown by the thick line TL in FIG. 17. FIG. 17 shows the adhesive coating mechanism 29 as having been moved to its ineffective position. FIG. 17 also shows that point C, which is between point A and point B, is immediately between a movable knife 50 and a cooperable fixed knife 51 at the instant of cutting. The knives 50 and 51 completely sever the web W, and more specifically all narrow slit webs, transversely at point C. As shown, the transverse severing takes place in the gap portion GP between points A and C to provide the web sections WS each having preferably a leading gap portion LGP and a trailing gap portion TGP. In order to form an inner loop 25 is it only necessary to provide a leading gap portion LGP, in which event the transverse severing at C would occur at or coincide with point B; in like manner, in order to form an outer loop 23 it is only necessary to provide a trailing gap portion TGP, in which event the transverse severing at C would occur at or coincide with point B. In both cases, the transverse severing, that is, point C, is still considered to be in the gap portion GP. The web W is cut at point C. The part of the web W between point A and point C becomes the trailing gap portion TGP of one web section WS1, and the part of the web W between point C and point B becomes the leading gap portion LGP of the next successive web section WS2. The trailing gap portion TGP becomes the outer portion of the web WS1 on the roll R and the leading gap portion becomes the inner portion of the web WS2 on the next successive roll to be formed on the mandrel 46. The transverse severing of the web W at points C is preferably made at equally spaced apart intervals to provide web sections WS of preferably equal length. Because the transverse severing in the web W at points C is made at the same location in each gap portion GP, each resulting web section WS has a leading gap portion LGP equal in length to each other leading gap portion LGP, and each resulting web section WS has a trailing gap portion TGP equal in length to each other trailing gap portion TGP.

Figure 5:
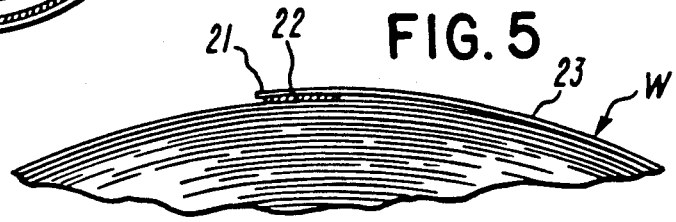
FIG. 5 is a fragmentary view of the outer portion of the wound roll showing the manner in which the outer loop of the web is adhesively held in loop form.

When the knife 50 moves into cutting cooperation with the knife 51, the inner loop 25 is deflected into contact with an adhesive applying mechanism 52 which applies the adhesive 22 directly to the outer marginal edge 21. As the mandrel 45 continues to rotate, a pressure roll 53 moves from its ineffective position shown in FIG. 17 to its effective position shown in FIG. 18. This causes the adhesive 22 on the marginal edge to be pressed into contact with the underlying wrap to produce the result shown in FIGS. 1 and 5.

When the web W has been cut at point C, the leading gap portion LGP starts to be adhered to adhesive 24 on the core 20 on the mandrel 46 as shown in FIG. 18. As shown the leading gap portion LGP represented by the part of the web between points C and B is longer than the outside diameter of the core 20. This assures that the marks 26 stop short of the place where adhesive 24 is applied to the web W.

By way of example, not limitation, a typical core 20 has an inside diameter of 4 inches (10.16 cm) and in outside diameter of 4.25 inches (10.795 cm). The outside diameter of the roll R is approximately 9.75 inches (24.765 cm). The length of a tag T is 2.44 inches (6.197 cm). The length of the web section WS from its inner terminal end 25' to its outer terminal end 21' is 813.33 feet (247.896 m). There are 4,000 tags T in the web section WC. A typical length for the leading gap portion LGP is 18 inches (45.720 cm) and 34 inches (88.360 cm) for the trailing gap portion TGP.

In general it is seen that the leading gap portion LGP is slightly longer than the circumference of the core 20 and that the trailing gap portion TGP is slightly longer than the circumference of the roll R, minus the extent of the outer loop 25. In this way, adhesive, such as the adhesive 22 on the marginal edge 21 or adhesive from the tape 28 cannot contact the thermal print head. Consequently, the ratio of length of the trailing gap portion TGP to the leading gap portion LGP is approximately equal to the ratio of the circumference of the wound roll R (or R') to the circumference of the core 20. Preferably the leading gap portion LGP is less than twice the circumference of the core 20 (or the circumference of the inner loop 25 in the core of a coreless roll).

While machine-readable marks 26 have been referred to are printed marks, the term machine-readable marks is intended to include marks either visible or invisible to the human eye, and also to include holes or notches which can be sensed by a sensor in the printer.

Although the invention has been described as being useful in connection with webs for thermal printers, the invention is useful for webs that are used in other types of printers or cutters in which adhesive on various printer parts and/or cut-off mechanisms can be a problem. In addition, even where adhesive is not a problem, the invention is also useful in providing an outer wrap for a wound roll of record members, such as a tag roll or a label roll, where it is desired to protect the tags or labels inside the outer loop from dirt, damage and the like.

Other embodiments and modifications of the invention will suggest themselves to those skilled in the art, and all such of these as come within the spirit of this invention are included within its scope as best defined by the appended claims.

I claim:

1. Method of making wound rolls of record members for use in a printer, comprising the steps of: providing a longitudinally extending web of printable record material, printing machine-readable marks on the web with the marks being arranged in longitudinally spaced groups with intervening mark gap portions between the groups and with the marks within each occurring at equally spaced apart intervals, advancing the web in a leading direction, completely severing the web transversely at selected longitudinal positions only within each mark gap portion to provide web sections each having a leading mark gap portion and a trailing mark gap portion, wherein the step of printing the machine-readable marks occurs before the step of completely severing the web transversely, providing a core for each web section, wherein the transverse severing makes the leading mark gap portions of substantially equal length with each leading mark gap portions of substantially equal length with each leading mark gap portion being at least slightly longer than a circumference of the respective core and makes the trailing mark gap portions of substantially equal length with each trailing mark gap portion being at least slightly longer than a circumference of the wound roll, adhesively securing the leading mark gap portion of each web section to its respective core, winding the remainder of each web section onto the respective core, each trailing mark gap portion forming an outer loop of the respective wound roll, and adhesively securing each trailing mark gap portion in loop form about the remainder of the respective web section.

2. Method as defined in claim 1, wherein the trailing mark gap portions are longer than the leading mark gap portions.

3. Method as defined in claim 1, wherein the ratio of the length of each trailing mark gap portion to the adjacent leading mark gap portion is approximately equal to the ratio of the circumference of the wound roll to the circumference of the core.

4. Method of making wound rolls of record members for use in a printer, comprising the steps of: providing a longitudinally extending web of printable record material, printing machine-readable marks on the web with the marks being arranged in longitudinally spaced groups with intervening mark gap portions between the groups and with the marks within each mark group occurring at equally spaced apart intervals, advancing the web in a leading direction, completely severing the web transversely at a selected longitudinal position only within each mark gap portion to provide a leading mark gap portion and a trailing mark gap portion, wherein the step of printing the machine-readable marks occurs before the step of completely severing the web transversely, winding the leading gap mark portion to provide an inner loop, securing each inner loop in loop form, winding the remainder of each web section about its inner loop, each trailing ark gap portion forming an outer loop of the respective wound roll, adhesively securing each trailing mark gap portion in loop form about the remainder of the respective web section, and wherein the transverse severing makes the leading mark gap portions of substantially equal length, with each leading mark gap portion being at least slightly longer than a circumferential extent of the respective inner loop, and makes the trailing mark gap portions of substantially equal length, with each trailing mark gap portion being at least slightly longer than a circumference of the wound roll.

5. Method as defined in claim 4, wherein the trailing mark gap portions are longer than the leading mark gap portions.

6. Method as defined in claim 4, wherein the ratio of the length of the trailing mark gap portion to the leading mark gap portion is approximately equal to the ratio of the circumference of the wound roll to the circumferential extent of the inner loop.

7. Method of making wound rolls of record members for use in a printer, comprising the steps of: providing a longitudinally extending web of printable record material, printing machine-readable marks on the web with the marks being arranged in longitudinally spaced groups with intervening mark gap portions between the groups and with the marks within each group occurring at equally spaced apart intervals, advancing the web in a leading direction, completely severing the web transversely at selected longitudinal positions only within each intervening mark gap portion to provide web sections with leading mark gap portions, wherein the step of printing the machine-readable marks occurs before the step of completely severing the web transversely, providing a core for each web section, the complete severing providing a leading mark gap portion longer than a circumference of the core, adhesively securing the leading mark gap portion to the respective core, and winding the remainder of each web section onto the respective core.

8. Method as defined in claim 7, wherein the web sections provided by the severing step are generally equal in length and the leading mark gap portions are generally equal in length.

9. Method as defined in claim 7, wherein the securing step includes applying adhesive directly to the respective core.

10. Method as defined in claim 7, wherein the securing step includes applying at least one continuous circumferential stripe of adhesive to the outer periphery of the core.

11. Method as defined in claim 7, wherein each leading mark gap portion is made less than twice the circumference of the core.

12. Method as defined in claim 7, wherein all the intervening mark gap portions are generally equal in length.

13. Method of making wound rolls of record members for use in a printer, comprising the steps of: providing a longitudinally extending web of printable record material, printing machine-readable marks on the web with the marks being arranged in longitudinally spaced groups with intervening mark gap portions between the groups and with the marks within each group occurring at equally spaced apart intervals, advancing the web in a leading direction, completely severing the web transversely at selected longitudinally positions only within each mark gap portion to provide web sections with leading mark gap portions, wherein the step of printing the machine-readable marks occurs before the step of completely severing the web transversely, winding each leading mark gap portion to provide an inner loop, securing each inner loop in loop form, and winding the remainder of each web section about its inner loop.

14. Method as defined in claim 13, wherein all the web sections provided by the severing step are generally equal in length and all the leading mark gap portions are generally equal in length.

15. Method as defined in claim 13, wherein the leading mark gap portion is made less than twice the extent of the inner loop.

16. Method as defined in claim 13, wherein the securing step includes adhesive for holding the inner loop in loop form.

17. Method as defined in claim 13, wherein all the intervening mark gap portions are generally equal in length.

18. Method of making wound rolls of record members for use in a printer, comprising the steps of: providing a longitudinally extending web of printable record material, printing machine-readable marks on the web with the marks being arranged in longitudinally spaced groups with intervening mark gap portions between the groups and with the marks within each group occurring at equally spaced apart intervals, advancing the web in a leading direction, completely severing the web transversely at a selected longitudinal position only within each mark gap portion to provide web sections with trailing mark gap portions, wherein the step of printing the machine-readable marks occurs before the step of completely severing the web transversely, winding each web section to form a wound roll, each trailing mark gap portion forming an outer loop of the respective wound roll, and adhesively securing each trailing mark gap portion in loop form about the remainder of the respective web section.

19. Method as defined in claim 18, wherein the intervening mark gap portions are generally the same length and the trailing mark gap portions are generally the same length.

20. Method as defined in claim 18, wherein the trailing mark gap portions are generally the same length.

21. Method as defined in claim 18, wherein the trailing mark gap portion is longer than a circumference of the wound roll.

22. Method as defined in claim 18, wherein the intervening mark gap portions are generally equal in length.

23. Method as defined in claim 18, wherein the trailing preprint gap portions are generally the same length.

24. Method as defined in claim 18, wherein each trailing preprint gap portion is longer than the circumference of the wound roll.

25. Method of making wound rolls of record members for use in a printer, comprising the steps of: providing a longitudinally extending web of printable record material, preprinting information on the web in accordance with a series of record members lengthwise of the web with preprinted information resulting from the preprinting being arranged in longitudinally spaced groups with intervening preprint gap portions between the groups and with the preprinted information within each group occurring at equally spaced apart intervals, advancing the web in a leading direction, completely severing the web transversely at a selected longitudinal position only within each preprint gap portion to provide web sections each having a leading preprint gap portion and a trailing preprint gap portion, wherein the step of preprinting information occurs before the step of completely severing the web transversely, providing a core for each web section, wherein the transverse severing makes the leading preprint gap portions of substantially equal length with each leading preprint gap portion being at least slightly longer than a circumference of the respective core and makes the trailing preprint gap portions of substantially equal length with each trailing preprint gap portion being at least slightly longer than a circumference of the wound roll, adhesively securing only the leading preprint gap portion of each web section to its respective core, winding the remainder of each web section onto the respective core, each trailing preprint gap portion forming an outer loop of the respective wound roll, and adhesively securing each trailing preprint gap portion in loop form about the remainder of the respective web section.

26. Method as defined in claim 25, wherein the trailing gap portions are longer than the leading preprint gap portions.

27. Method as defined in claim 25, wherein the ratio of the length of the trailing preprint gap portion to the leading preprint gap portion is approximately equal to the ratio of the circumference of the wound roll to the circumference of the core.

28. Method of making wound rolls of record members for use in a printer, comprising the steps of: providing a longitudinally extending web of printable record material, preprinting information on the web in accordance with a series of record members lengthwise of the web with preprinted information resulting from the preprinting being arranged in longitudinally spaced groups with intervening preprint gap portions between the groups and with the preprinted information within each group occurring at equally spaced apart intervals, advancing the web in a leading direction, completely severing the web transversely at a selected longitudinal position only within each preprint portion to provide web sections each having a leading preprint gap portion and trailing preprint gap portion, wherein the step of preprinting information occurs before the step of completely severing the web transversely, winding each leading preprint gap portion to provide an inner loop, securing each inner loop in loop form, winding the remainder of the web section about its inner loop, each trailing preprint gap portion forming an outer loop of the respective wound roll, adhesively securing each trailing preprint gap portion in loop form about the remainder of the respective web section, and wherein the severing makes the leading preprint gap portions of substantially equal length with each leading preprint gap portion being at least slightly longer than a circumferential extent of the respective inner loop and makes the trailing preprint gap portions of substantially equal length with each trailing preprint gap portion being at least slightly longer than a circumference of the wound roll.

29. Method as defined in claim 18, wherein the trailing preprint gap portions are longer than the leading gap portions.

30. Method of making wound rolls of record members for use in a printer, comprising the steps of: providing a longitudinally extending web of printable record material, preprinting information on the web in accordance with a series of record members lengthwise of the web with preprinted information resulting from the preprinting being arranged in longitudinally spaced groups with intervening preprint gap portions between the groups and with the preprinted information within each group occurring at equally spaced apart intervals, advancing the web in a leading direction, completely severing the web transversely at a selected longitudinal position only with each preprint gap portion to provide web sections with trailing preprint gap portions, winding each web section to form a wound roll, wherein the step of preprinting information occurs before the step of completely severing the web transversely, each trailing preprint gap portion forming an outer loop of the respective wound roll, and adhesively securing each trailing preprint gap portion in loop form about the remainder of the respective web section.

31. Method as defined in claim 30, wherein the intervening preprint gap portions are generally the same length and the trailing preprint gap portions are generally the same length.

32. Method as defined in claim 30, wherein the severing step makes the trailing preprint gap portions of generally equal length and at least slightly longer than a circumference of a wound roll.

33. Method of making wound rolls of record members for use in a printer, comprising the steps of: providing a longitudinally extending web of record material having opposite printable sides, preprinting information on one side of the web in accordance with a series of record members extending lengthwise of the web, with repetitively occurring preprinted information resulting from the preprinting being arranged in longitudinally spaced preprint groups with intervening preprint gap portions between the preprint groups and with the preprinted information within each preprint group occurring at equally spaced apart intervals, printing machine-readable marks on the other side of the web with the marks being arranged in longitudinally spaced mark groups with intervening mark gap portions between the mark groups and with the marks within each mark group occurring at equally spaced apart intervals, wherein each mark is registered with said preprinted information, advancing the web in a leading direction, completely severing the web transversely at a selected longitudinal position only within each preprint and mark gap portion to provide web sections having a leading preprint and mark gap portion and a trailing preprint and mark gap portion, wherein the steps of preprinting information and printing machine-readable marks occur before the step of completely severing the web transversely, providing a core for each web section, wherein the transverse severing makes all the leading preprint and mark gap portions of substantially equal length with each leading preprint and mark gap portion being at least slightly longer than a circumference of the respective core and makes the trailing preprint and mark gap portions of substantially equal length, with each trailing preprint and mark gap portion being at least slightly longer than a circumference of the wound roll, adhesively securing only the leading preprint and mark gap portion of each web section to its respective core, winding the remainder of each web section onto the respective core, each trailing preprint and mark gap portion forming an outer loop of the respective wound roll, and adhesively securing each trailing preprint and mark gap portion in loop form about the remainder of the respective web section.

34. Method of making wound rolls of record members for use in a printer, comprising the steps of: providing a longitudinally extending web of record material having opposite printable sides, preprinting information on one side of the web in accordance with a series of record members extending lengthwise of the web, with repetitively occurring preprinted information resulting from the preprinting being arranged in longitudinally spaced preprint groups with intervening preprint gap portions between the preprint groups and with the preprinted information within each preprint group occurring at equally spaced apart intervals, printing machine-readable marks on the other side of the web with the marks being arranged in longitudinally spaced mark groups with intervening mark gap portions between the mark groups and with the marks within each mark group occurring at equally spaced apart intervals, wherein each mark is registered with said preprinted information, advancing the web in a leading direction, completely severing the web transversely at a selected position only within each preprint and mark gap portion to provide web sections each having a leading preprint and mark gap portion and a trailing preprint and mark gap portion, wherein the steps of preprinting information and printing machine-readable marks occur before the step of completely severing the web transversely, winding each leading preprint and mark gap portion to provide an inner loop, securing each inner loop in loop form, winding the remainder of each web section about its inner loop, each trailing preprint and mark gap portion forming an outer loop of the respective wound roll, adhesively securing each trailing preprint and mark gap portion in loop form about the remainder of the respective web section, and wherein the transverse severing makes the leading preprint and mark gap portions of substantially equal length with each leading preprint and mark gap portion being at least slightly longer than the circumferential extent of the respective inner loop and makes the trailing preprint and mark gap portions of substantially equal length with each trailing preprint and mark gap portion being at least slightly longer than the circumference of the wound roll.

35. Method of making wound rolls of record members for use in a printer, comprising the steps of: providing a longitudinally extending web of record material having opposite printable sides, preprinting information on one side of the web in accordance with a series of record members extending lengthwise of the web, with repetitively occurring preprinted information resulting from the preprinting being arranged in longitudinally spaced preprint groups with intervening preprint gap portions between the preprint groups and with the preprinted information within each preprint group occurring at equally spaced apart intervals, printing machine-readable marks on the other side of the web with the marks being arranged in longitudinally spaced mark groups with intervening mark gap portions between the mark groups and with the marks within each mark group occurring at equally spaced apart intervals, wherein each mark is registered with said preprinted information, advancing the web in a leading direction, completely severing the web transversely at a selected longitudinal position only within each preprint and mark gap portion to provide web sections with trailing preprint and mark gap portions, wherein the steps of preprinting information and printing machine-readable marks occur before the step of completely severing the web transversely, winding the web section to form a wound roll, each trailing preprint and mark gap portion forming an outer loop of the respective wound roll, and adhesively securing each trailing preprint and mark gap portion in loop form about the remainder of the respective web section.

* * * * *

UNITED STATES PATENT AND TRADEMARK OFFICE

CERTIFICATE OF CORRECTION

PATENT NO. : 5,086,987

DATED : February 11, 1992

INVENTOR(S) : Roung-Min David Shieh

It is certified that error appears in the above-identified patent and that said Letters Patent is hereby corrected as shown below:

Title page, item [75] Inventor: "Roung-Min Shieh" should read --Roung-Min D. Shieh--. Column 1, line 9, after "and" --to method-- has been omitted. Column 10, line 11, "portions" should be --portion--, line 51, "ark" should be --mark--. Column 13, line 43, "18" should be --28--, line 58, "with" should be --within--.

Signed and Sealed this

Twenty-fourth Day of August, 1993

Bruce Lehman

*Attest:*

BRUCE LEHMAN

*Attesting Officer*

*Commissioner of Patents and Trademarks*